US006405542B1

(12) United States Patent
Matta

(10) Patent No.: US 6,405,542 B1
(45) Date of Patent: Jun. 18, 2002

(54) LIQUID REFRIGERANT SEPARATOR

(75) Inventor: Galal Naguib Matta, Troy, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/764,201

(22) Filed: Jan. 17, 2001

(51) Int. Cl.[7] ..... F25B 47/00

(52) U.S. Cl. ..... 62/85; 62/503; 62/509; 62/470

(58) Field of Search ..... 62/503, 470, 195, 62/471, 473, 509, 83, 84, 85

(56) References Cited

U.S. PATENT DOCUMENTS

| | | | | |
|---|---|---|---|---|
| 2,709,342 A | | 5/1955 | Zearfoss, Jr. | |
| 3,412,574 A | | 11/1968 | Reiter | |
| 3,636,723 A | | 1/1972 | Kramer | |
| 5,605,058 A | * | 2/1997 | Kurachi et al. | 62/503 |
| 5,787,728 A | | 8/1998 | Das et al. | |

FOREIGN PATENT DOCUMENTS

JP 07198220 A * 8/1995

* cited by examiner

*Primary Examiner*—Chen-Wen Jiang
(74) *Attorney, Agent, or Firm*—Brinks Hofer Gilson & Lione

(57) ABSTRACT

A refrigeration system including a condenser, a compressor, an evaporator and an accumulator is provided. The refrigeration system includes a device for preventing condensation of liquid refrigerant in the compressor when the refrigeration is switched off for a prolonged period of time. Particularly, the device comprises a first reservoir that is a part of the conduit connecting the compressor and the accumulator. The first reservoir is placed below the body of the compressor and has a larger cross-section than the rest of the conduit. The present invention also includes a second reservoir in the conduit connecting the compressor and the condenser. Like the first reservoir, the second reservoir is also placed below the body of the compressor and has a larger cross-section than the rest of the conduit. The condensation of the refrigerant in the compressor is prevented by the following method when the refrigeration system is shut off the vapor present in the conduit condense in the conduit. As the refrigeration system continues to cool the liquid formed in the conduit will get collected in the reservoirs. Since the reservoirs are placed vertically below the compressor all of the liquid is collected in the reservoirs and prevented from traveling to the body of the compressor.

39 Claims, 3 Drawing Sheets

LIQUID REFRIGERANT SEPARATOR

TECHNICAL FIELD OF THE INVENTION

This invention generally relates to refrigeration system to be used in automobiles. More specifically, this invention relates to a liquid refrigerant separator that prevents condensation of liquid refrigerant in the compressor during off cycle when the engine is switched off.

BACKGROUND OF THE INVENTION

Modern refrigerant compressor technology has generated designs which provide the maximum capacity per unit, weight, cost and efficiency. The compressors are generally designed for high rotative speeds and high bearing loads. In order to achieve these features it is important for these compressors not to have any liquid of any sort. Liquid can cause undue loads and NVH in the compressor chamber.

Liquid entering the cylinder can stem from two sources liquid oil can enter the cylinder from foaming of the oil in the compressor crankcase on start up. The other source of liquid is liquid refrigerant in relatively pure form, which can return under abnormal conditions through the suction or discharge lines.

If large quantities of liquid refrigerant enter the compressor much of the refrigerant will be entrapped into the cylinder with the vapor and will cause a condition known as slugging which accompanied by pounding and knocking sounds could cause compressor damage.

The liquid refrigerant can also return to the compressor in small quantities but over a period of time. This can happen in two ways. The first is when the refrigerant vapor condenses in the compressor over a prolonged period of time. The other way liquid refrigerant can enter the compressor is during start-ups. In order to prevent any liquid from entering the compressor, modern technology have developed suctions drums or surge accumulators whose sole purpose is to catch the liquid refrigerant returning in large or small quantities and prevent this potentially harmful liquid refrigerant from reaching the compressor. A suction accumulator is usually positioned between an evaporator and the compressor in an air conditioning unit. During operation, the suction accumulator receives the combined liquid and vapor from the evaporator via an inlet tube. Vapor passes on to the compressor via an outlet tube. Over the years various technologies have been developed to insure that only vapor passes through the suction tube and reaches the compressor. The suction accumulators prevent any liquid refrigerant from reaching the compressor.

However, when the system is turned off for a prolonged period, and the outdoor ambient temperature is less than the indoor ambient temperature, the compressor can become the coldest part of an air conditioning system. When this occurs, the refrigerant migrates to the compressor sometimes filling it completely with liquid refrigerant. Although modern technologies have devised systems to prevent any liquid refrigerant from reaching the compressor during use of the system, technology has yet to be developed to prevent any condensation of vapor refrigerant in the compressor when the system is turned off for a prolonged period of time.

Therefore there is a need for a refrigeration system that will prevent substantial condensation of a vapor refrigerant in the compressor when the system is turned off for a prolonged period of time.

BRIEF SUMMARY OF THE INVENTION

Accordingly, this invention provides for a refrigeration system that prevents condensation of the liquid refrigerant in the compressor when the system is shut off for a prolonged period of time.

Briefly, the invention includes a compressor for compressing vapor refrigerant, a condenser for condensing liquid refrigerant discharged out of the compressor, an evaporator for converting liquid refrigerant into vapor refrigerant and an accumulator for preventing liquid refrigerant from reaching the compressor.

The refrigeration system includes a device for preventing condensation of liquid refrigerant in the compressor when the refrigeration is switched off for a prolonged period of time.

The device comprises a first reservoir that is a part of the conduit connecting the compressor and the accumulator. The first reservoir is placed below the body of the compressor and has a larger cross-section than the rest of the conduit.

The present invention also includes a second reservoir in the conduit connecting the compressor and the condenser. Like the first reservoir, the second reservoir is also placed below the body of the compressor.

The present invention also provides for a method of preventing condensation of the refrigerant in the compressor. When the refrigeration system is shut off the vapor present in the conduit condense in the conduit. As the refrigeration system continues to cool the liquid formed in the conduit will get collected in the reservoirs. Since the reservoirs are placed vertically below the compressor all of the liquid is collected in the reservoirs and prevented from traveling to the body of the compressor.

BRIEF DESCRIPTION OF THE DRAWINGS

Further features and advantage of the invention will become apparent from the following discussions and accompanying drawings.

DETAILED DESCRIPTION OF THE INVENTION

The following description of the preferred embodiment is merely exemplary in nature, and is in no way intended to limit the invention or its application or uses.

Referring in particular to the drawings, a closed circuit refrigeration system 10 in accordance with the preferred embodiment for use in automobiles is generally illustrated.

Figure 1:
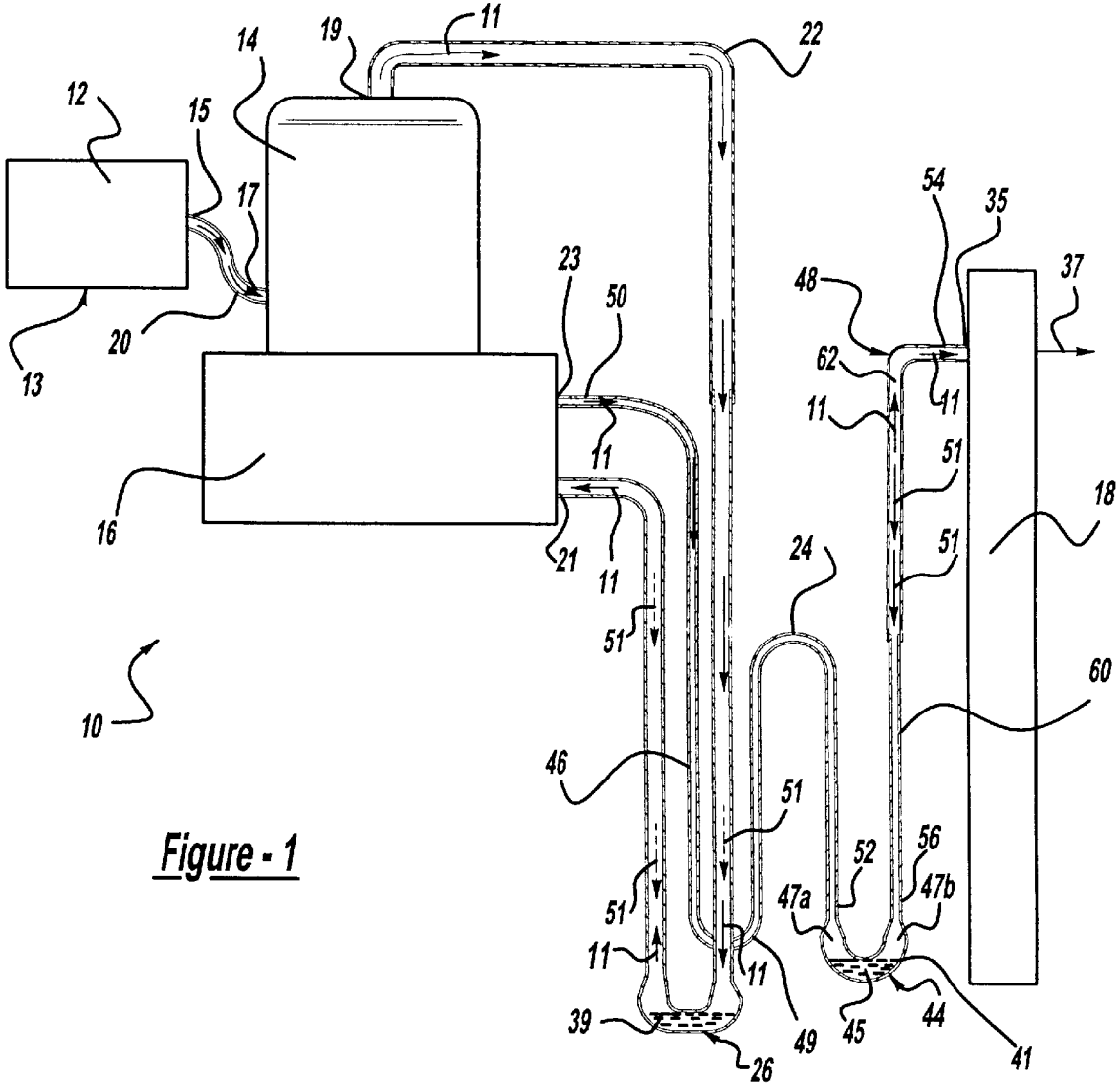
FIG. 1 is a front perspective view of the refrigeration system in accordance with the teachings of the preferred embodiment of the invention.

As shown in FIG. 1, the refrigeration system 10 circulates a refrigerant in the direction as shown by arrows 11 either to supply heat or to remove heat from the air supplied to the refrigeration system 10. Typically the refrigeration system comprises an evaporator 12, an accumulator 14, a compressor 16 and a condenser 18.

The evaporator 12 is a conventional evaporator and preferably includes an inlet end 13 for receiving the liquid refrigerant, an outlet end 15 for discharging vapor refrigerant and a heating element (not shown in the FIGURE) to heat the liquid refrigerant and to convert the liquid refrigerant into vapor refrigerant. The inlet end 13 of the evaporator 12, preferably is connected by a conduit (not shown) to an evaporation valve (not shown). The evaporator 12 may not include some of these elements or include other elements to heat the liquid refrigerant when the refrigeration system 10 is turned on. The accumulator 14, which functions to retain any liquid refrigerant not evaporated by the evaporator 12, preferably includes an inlet end 17 for receiving the vapor and or liquid refrigerant from the evaporator 12, an outlet end 19 for discharging the vapor refrigerant to the compressor 16. The outlet end 15 of the evaporator 12 and the inlet end 17 of the accumulator 14 are preferably connected through a conduit 20. The accumulator 14 preferably is a vertical suction type accumulator conventional in the art, although it is possible to have a horizontal suction type accumulator. Preferably, the inlet end 17 of the accumulator is present at the bottom of the accumulator 14 and the outlet end 19 is present at the top of the accumulator 14.

The compressor 16, functions to compress the vapor refrigerant from the accumulator 14. Preferably, the compressor 16 comprises an inlet end 21 for receiving the vapor refrigerant; an outlet end 23 for discharging compressed vapor refrigerant and a high-speed motor (not shown) capable of compressing the vapor refrigerant. An outlet conduit 22 connects the outlet end 19 of the accumulator 14 and the inlet end 21 of the compressor 16. Preferably the outlet conduit 22 is a U shaped tube (as shown in FIG. 1). The condenser 18, functions to condense vapor refrigerant discharged from the compressor 16 to liquid refrigerant. The compressor 16 preferably comprises an inlet end 35, an outlet end 37 for discharging the liquid refrigerant and a cooling element (not shown) for condensing the vapor refrigerant to liquid refrigerant. The outlet end 37 of the condenser 18 is preferably connected to the inlet end 13 of the evaporator 12 through the evaporation valve. The inlet end 35 is connected to the outlet end 23 of the compressor 16 by a discharge conduit 24. Preferably, like the outlet conduit 22, the discharge conduit 24 is also a u-shaped tube.

In a typical working of a refrigeration system 10 a liquid refrigerant (not shown) is circulated inside the refrigeration system 10 as indicated by arrows 11. Typically the liquid refrigerant flowing inside the system 10 is evaporated at the evaporator 12. The vaporized refrigerant is then transported to the accumulator 14 where any liquid refrigerant present or mixed with the vaporized refrigerant is retained by the accumulator 14. Vaporized refrigerant is then discharged to the compressor 16 through the outlet conduit 22 whereby the vapor refrigerant is compressed. The compressed vapor is finally discharged to the condenser 18 through the discharge conduit 24, where the vapor refrigerant condenses back to a liquid refrigerant. From the condenser 18, the liquid refrigerant is re-circulated back to the evaporator 12.

Figure 2:
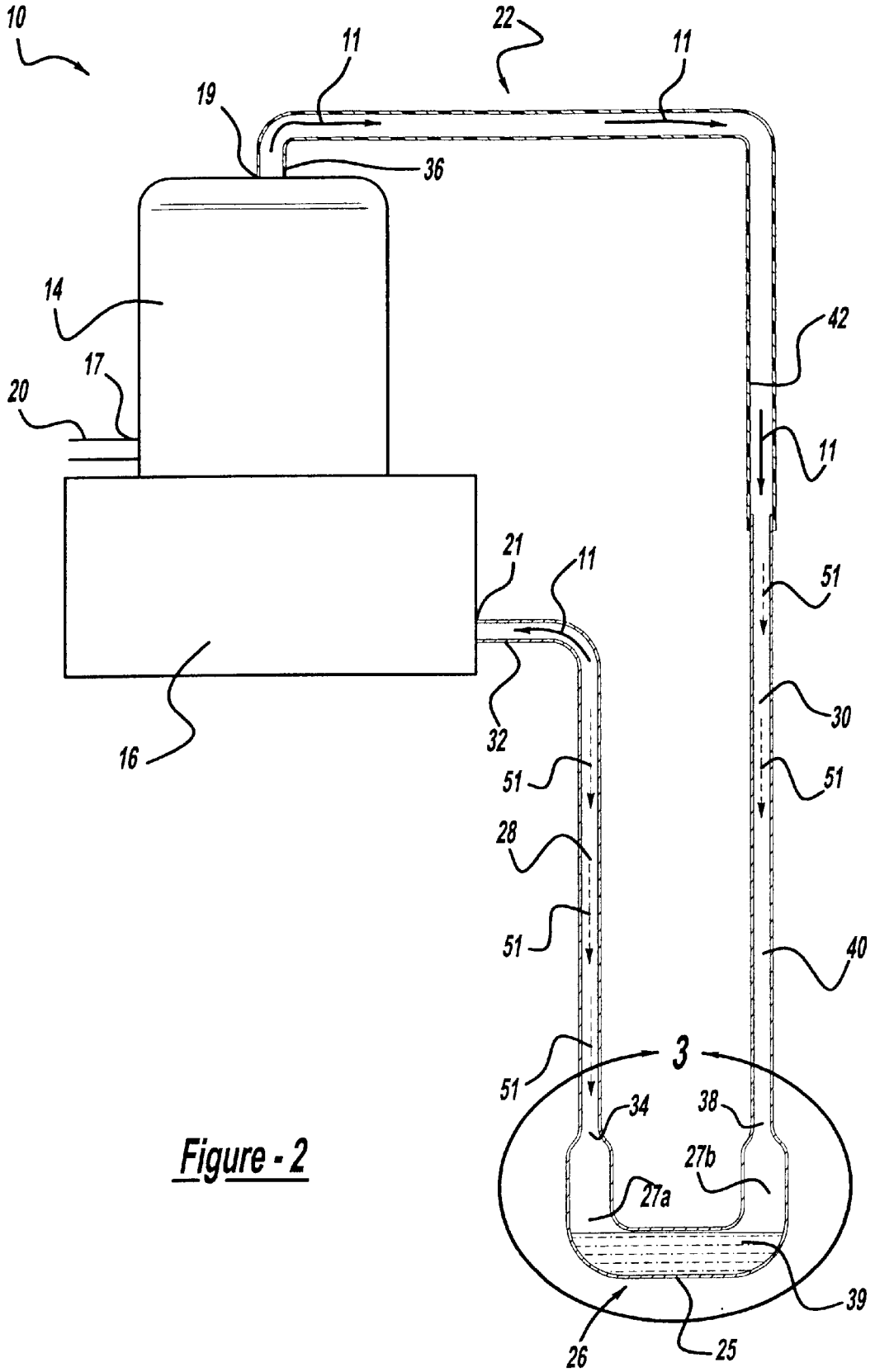
FIG. 2 is a partial front view of the refrigeration system comprising the compressor and the accumulator and the conduit from the accumulator to the compressor in accordance with the teachings of the present invention.
Figure 3:
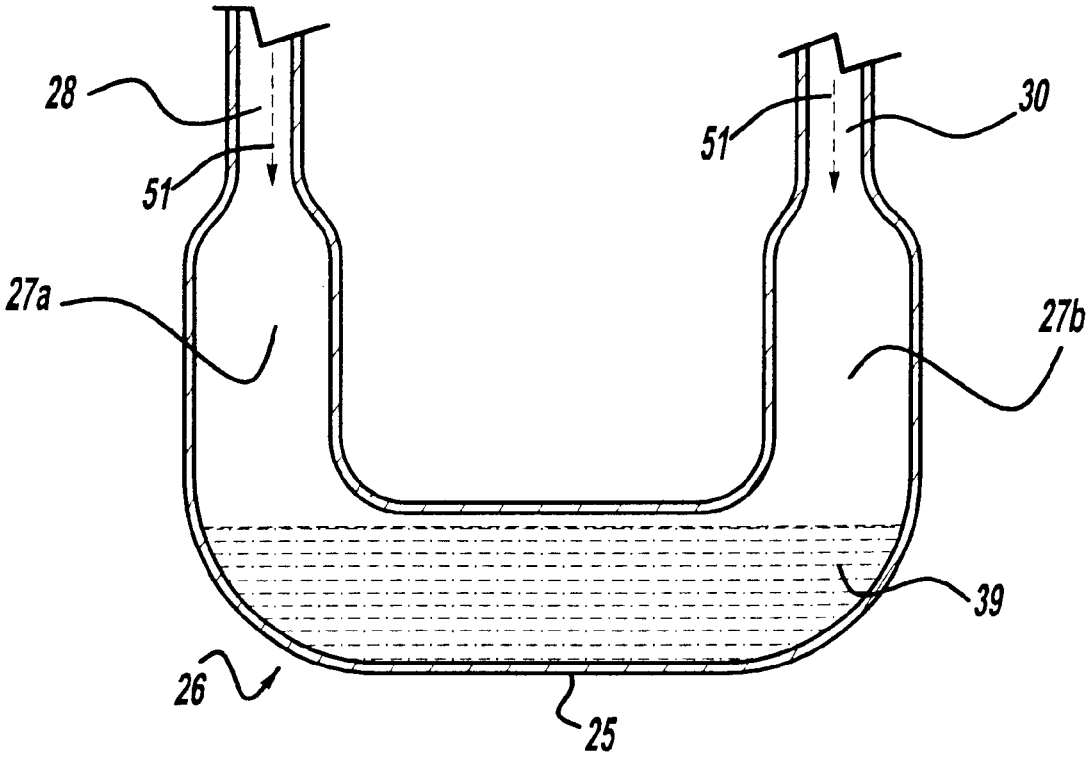
FIG. 3 is a cross section view of the conduit taken along the lines 2—2 in accordance with the preferred embodiment of the invention.

Referring in particular to FIGS. 2 and 3, the outlet conduit 22 consists of a first reservoir 26, a first flow portion 28 and a second flow portion 30. The first reservoir 26 is an integral part of the outlet conduit 22. The first reservoir 26 has a hollow interior (not shown). As will be discussed later, the first reservoir 26 serves to collect the liquid refrigerant condensed in the outlet conduit 22 and prevent the liquid from reaching the compressor 16 when the refrigeration system 10 is shut off for a prolonged time.

Preferably, the first reservoir 26 comprises a base 25 and two arms 27A and B. The base 25 and the arms 27A and B are formed of one piece and preferably are u-shaped. Alternatively, the first reservoir 26 may take any shape that can substantially collect liquid refrigerant as indicated by reference numeral 39 when the refrigeration system is turned off for a prolonged period of time. Preferably the base 25 of the first reservoir is positioned such that the base 25 is lower than the body of the compressor 16. As will be explained later, the liquid refrigerant will be substantially collected in the first reservoir 26 and prevented from reaching the compressor 16.

The first flow portion 28 at one end 32 is integrally connected to the inlet end 21 of the compressor 16. The other end 34 of the first flow portion 28 is connected to the first reservoir 26. Similarly, one end 36 of the second flow portion 30 is connected to the outlet end 19 of the accumulator 14 and the other end 38 is connected to the first reservoir 26. Preferably, the first flow portion 28 and second flow portion 30 have equal cross-section. Preferably, the first flow portion 28 has a diameter equal to the diameter of the second flow tube 30. Preferably, the first flow portion 28 and the second flow portion 30 are substantially parallel to each other. Alternatively the first flow portion 28 and the second flow portion 30 may be oriented substantially perpendicular to each other or at an angle with respect to each other. In the preferred embodiment, the first reservoir 26 has a larger cross section than the first flow portion 28 and the second flow portion 30. Preferably, the first reservoir 26 has an increased diameter than the first flow portion 28 and the second flow portion 30 for storing the liquid refrigerant.

In the preferred embodiment the first flow portion 28, the second flow portion 30 and the first reservoir 26 are formed of one integral piece. Preferably, the first reservoir 26 is made of a metallic material such as aluminum or stainless steel preferably the same material as the compressor 16. It is also preferred that the first flow portion 28 be made of the same metallic material as the compressor 16 and the first reservoir 26. Alternatively, the first reservoir 26 and the first flow portion 28 may be made of a non-metallic material or a combination of a metallic and non-metallic material. The second flow portion 30 may be made of metallic material or of a non-metallic material. Preferably, the second flow portion 30 is made from a combination of metallic material and non-metallic material. Preferably the metallic portion 40 of the second flow portion 30 is connected to the first reservoir 26 and the non-metallic portion 42 is connected to the outlet end 19 of the accumulator 14. Preferably the non-metallic portion 42 of the second flow portion 30 is made of a non-conductive material such as rubber or plastic. The metallic portion 40 is preferably made of the same metallic material as the first flow portion 28 such as aluminum or steel.

Referring in particular to FIGS. 1, the discharge conduit 24 in the refrigeration system 10 consists of a second reservoir 44, a first flow portion 46 and a second flow portion 48. The second reservoir 44 has a hollow interior (not shown). As will be discussed later, like the first reservoir 26, the second reservoir 44 serves to collect the liquid refrigerant condensed in the discharge conduit 24 and prevent the liquid refrigerant from reaching the compressor 16 when the refrigeration system 10 is shut off for a prolonged time.

Preferably, the second reservoir 44 comprises a base 45 and two arms 47 A and B. The base 45 and the arms 47 A and B are formed of one piece and preferably are u-shaped. Alternatively, the second reservoir 44 may take any shape that can substantially collect liquid refrigerant as indicated by reference numeral 41 when the refrigeration system 10 is turned off for a prolonged period of time. Preferably the base 45 of the second reservoir 44 is positioned such that the base 45 is lower than the body of the compressor 16. Preferably the second reservoir 44 is positioned above the first reservoir 26 such that the first reservoir 26 is the lowest part in the refrigeration system 10. Alternatively, it is possible that the second reservoir 44 is placed in any position where it can collect liquid refrigerant condensed on discharge conduit 24 and prevent the refrigerant from reaching the compressor 16. As will be explained later, the liquid refrigerant will substantially collect in the second reservoir 44 and will be prevented from reaching the compressor 16.

The first flow portion 46 at one end 50 is integrally connected to the outlet end 23 of the compressor 16. The other end 52 of the first flow portion 46 is connected to the arm 47A of the second reservoir 44. Similarly, one end 54 of the second flow portion 48 is connected to the inlet end 35 of the condenser 18 and the other end 56 is connected to the arm 47B of the second reservoir 44. The first flow portion 46 and second flow portion 48 have equal cross-sections. Preferably, the first flow portion 46 and second flow portion 48 have equal diameter. Preferably, the first flow tube 46 and the second flow tube 48 are substantially parallel to each other. Alternatively the first flow portion 46 and the second flow portion 48 may be oriented substantially perpendicular to each other or at an angle with respect to each other. In the preferred embodiment, the second reservoir 44 has a larger cross section than the first flow portion 46 and the second flow portion 48. Preferably, the second reservoir 44 has an increased diameter as compared to the first flow portion 46 and second flow portion 48.

Preferably, as seen in FIG. 1, first flow portion 46 is of winding shape having a u-section 49. Alternatively, the first flow portion 46 may be formed without this u-section 49, hence resembling the first flow portion 26 of the outlet conduit 24. In the preferred embodiment the first flow portion 46, the second flow portion 48 and the second reservoir 44 are formed of one integral piece. In the preferred embodiment, the second reservoir 44 is made of a metallic material such as aluminum or stainless steel, preferably the same material as the compressor 16. It is also preferred that the first flow portion 46 be made of the same metallic material as the compressor 16 and the second reservoir 44. Alternatively, the second reservoir 44 and the first flow portion 46 may be made of a non-metallic material or a combination of a metallic and non-metallic material. The second flow portion 48 may be made of metallic material or of a non-metallic material. Preferably, the second flow portion 48 is made from a combination of metallic material and non-metallic material. Preferably the metallic portion 60 of the second flow portion 48 is connected to the second reservoir 44 and the non-metallic portion 62 is connected to the inlet end 35 of the condenser 18. Preferably the non-metallic portion 62 of the second flow portion 48 is made of a non-conductive material such as rubber or plastic. The metallic portion 60 is preferably made of the same metallic material as the first flow tube 46 such as aluminum or steel.

The refrigeration system 10, in accordance with the teachings of the present invention may include a third reservoir (not shown) formed as a part of the conduit 20. The third reservoir like the first reservoir 26 and the second reservoir 44 is made of the same metallic material as the compressor 16.

The refrigeration system 10. in accordance with the teachings of the present invention will prevent condensation of vapor refrigerant in the compressor 16 in the following manner. Once refrigeration system 10 is turned off the compressor 16 typically is the coldest part of the refrigeration system 10. The change in temperature will force the vapor refrigerant to flow towards the compressor 16 as the temperature continues to drop. Since the first flow portion 28, the metallic portion 40 of the second flow portion 30, are made of the same metallic material as the compressor 16, they are maintained at the same temperature as the compressor 16. Due to gravity, the vapor refrigerant flowing towards the compressor 16 comes in contact with the metallic portion 40. of the second flow portion 30 and the vapor refrigerant will condense in the tube 30. Similarly, the vapor present in the first flow portion 28 will condense in the first flow portion 28. Due to drop in pressure and gravity, the condensed liquid refrigerant present in the first flow portion 28 and the second flow portion 30 will then continue to flow (as shown by arrows 51) towards the first reservoir 26 where it will accumulate as liquid refrigerant represented by reference numeral 39. As discussed above since the first reservoir 26 is positioned below the compressor 16, the liquid refrigerant will be collected in the first reservoir 26 and will be prevented from reaching the compressor 16.

Similarly. the discharge conduit 24 will have a substantial amount of vapor refrigerant present when the refrigeration system is turned off. As discussed above the vapor present in the first flow portion 46 and the second flow portion 48 will flow towards the second reservoir 44 (as shown by arrows 51) and be collected as liquid refrigerant as indicated by reference numeral 41.

When the refrigeration system 10 is operated in other words during start up, the liquid refrigerant present in the first reservoir 26 and second reservoir 44 are sucked into the accumulator 14. When the refrigeration system 10 is operated, the refrigerant liquid is pushed toward the condenser 18. The refrigerant liquid present in the reservoir 26 will be vaporized before reaching the compressor 16 due to the negative suction exerted upon by the compressor 16.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A refrigeration system for use in an automobile, the system comprising:

a compressor for compressing a vapor refrigerant;

a condenser for condensing the compressed vapor refrigerant to liquid refrigerant;

an evaporator for evaporating liquid refrigerant discharged from the condenser;

an accumulator for storing the liquid refrigerant discharged from the evaporator, wherein the accumulator is connected to the evaporator by an inlet conduit;

a first conduit connecting the accumulator to the compressor, wherein a portion of the first conduit has a first reservoir for storing the refrigerant condensed in the first conduit when the compressor has been shut off, such that the first reservoir has a larger cross-section flow area than the rest of the first conduit;

a second conduit connecting the compressor to the condenser, wherein a portion of the second conduit has a second reservoir for storing the refrigerant condensed in the second conduit when the compressor is shut off such that the second reservoir has a larger cross-sectional flow area than the rest of the second conduit; and wherein the first reservoir and the second reservoir are positioned below the compressor such that liquid refrigerant condensed in the first and second conduit flows toward the first reservoir and the second reservoir and the liquid refrigerant is prevented from reaching the compressor.

2. The system of claim 1, wherein the first reservoir has an increased diameter than the rest of the first conduit.

3. The system of claim 1, wherein the second reservoir has an increased diameter than the rest of the second conduit.

4. The system of claim 1, wherein the first conduit comprises a first portion connected to the compressor and a second portion connected to the accumulator such that the first reservoir is between the first and second portion.

5. The system of claim 4, wherein the second portion of the first conduit is formed of a metallic part and a non-metallic part.

6. The system of claim 5, wherein the metallic part is connected to the first reservoir and the non-metallic part is conned to the accumulator.

7. The system of claim 1, wherein the second conduit comprises a first portion connected to the compressor and a second portion connected to the condenser such that the second reservoir is between the first and second portion.

8. The system of claim 7, wherein the second portion of the second conduit is formed of a metallic part and a non-metallic part.

9. The system of claim 8, wherein the metallic part is connected to the second reservoir and the non-metallic part is connected to the condenser.

10. The system of claim 1 further including means for extracting the liquid refrigerant present in the first reservoir and second reservoir when the refrigeration system is turned on after being turned off.

11. The system of claim 10, wherein the means extracts the liquid refrigerant away from the compressor and towards the accumulator.

12. The system of claim 1, wherein the first reservoir and the second reservoir are maintained at a predetermined temperature.

13. The system of claim 12, wherein the predetermined temperature is equal to the temperature of the compressor.

14. The system of claim 1, wherein the first and the second reservoir are formed of metallic material.

15. The system of claim 1, wherein the second reservoir is positioned vertically below the compressor and vertically above the first reservoir.

16. The system of claim 1 further comprising a third reservoir formed in the inlet conduit connecting the evaporator and the accumulator.

17. A device for preventing condensation of liquid refrigerant in a refrigeration system having a condenser, an accumulator, an evaporator and a compressor the device comprising:

a first reservoir formed in the conduit connecting the compressor to the accumulator such that the first reservoir stores the liquid refrigerant condensed in the conduit when the refrigeration system is shut off;

a second reservoir formed in the conduit connecting the compressor to the condenser such that the second reservoir stores the liquid refrigerant condensed in the conduit when the refrigeration system is shut off; and wherein the first reservoir and the second reservoir have a larger cross-section flow area than the rest of the conduit connecting the compressor to the accumulator and the conduit connecting the compressor to the condenser.

18. The device of claim 17 further comprising a third reservoir formed in the conduit connecting the evaporator to the accumulator wherein the third reservoir collects the liquid refrigerant condensed in the conduit when the refrigeration system is shut off.

19. The devise of claim 18, wherein the third reservoir is formed of a metallic material.

20. The device of claim 17 wherein the first reservoir and the second reservoir have an increased diameter than the rest of the conduit connecting the compressor to the accumulator and the conduit connecting the compressor to the condenser.

21. The device of claim 17 wherein the first reservoir and the second reservoir are positioned below the compressor such that liquid refrigerant condensed flows toward the first reservoir and the second reservoir and liquid refrigerant is prevented from reaching the compressor.

22. The device of claim 17, wherein the second reservoir is positioned vertically below the compressor and vertically above the first reservoir.

23. The device of claim 17, wherein the conduit connecting the compressor to the accumulator comprises a first portion connected to the compressor and a second portion connected to the accumulator such that the first reservoir is between the first and second portion.

24. The device of claim 23, wherein the second portion of the conduit connecting the compressor to the condenser is formed of a metallic part and a non-metallic part.

25. The device of claim 24, wherein the metallic part is connected to the first reservoir and the non-metallic part is connected to the accumulator.

26. The device of claim 17, wherein the conduit connecting the compressor to the condenser comprises a first portion connected to the compressor and a second portion connected to the condenser such that the second reservoir is between the first and second portion.

27. The device of claim 26, wherein the second portion of the conduit connecting the compressor to the condenser is formed of a metallic part and a non-metallic part.

28. The device of claim 27, wherein the metallic part is connected to the second reservoir and the non-metallic part is connected to the condenser.

29. The device of claim 17 further including means for extracting the liquid refrigerant present in the first reservoir and second reservoir when the refrigeration system is turned on.

30. The device of claim 29 wherein the means extracts the liquid refrigerant away from the compressor and towards the accumulator.

31. The device of claim 17, wherein the first reservoir and the second reservoir are maintained at a predetermined temperature.

32. The device of claim 31, wherein the predetermined temperature is equal to the temperature of the compressor.

33. The device of claim 17, wherein the first reservoir and the second reservoir are formed of metallic material.

34. The method of preventing condensation of the liquid refrigerant in the compressor of a refrigeration system including an evaporator, an accumulator, and a condenser when the refrigeration system is shut off, said method comprising the steps of:

providing a first reservoir in the conduit connecting the accumulator and the compressor;

providing a second reservoir in the conduit connecting the compressor and the condenser;

positioning the first and second reservoir such that when the liquid refrigerant condenses in the conduit the liquid refrigerant flows toward the first and second reservoir; and providing means for extracting the liquid refrigerant away from the first reservoir and second reservoir when the refrigeration system is switched on.

35. The method of claim 34 further comprising the step of providing a third reservoir in the conduit connecting the evaporator and the accumulator such that liquid refrigerant condensing in the conduit is collected in the third reservoir.

36. The method of claim 34 wherein the first and second reservoir are formed of a metallic material.

37. The method of claim 34 wherein the first and the second reservoir are maintained at a pre-determined temperature.

38. The method of claim 37 wherein the pre-determined temperature is the same as the temperature of the compressor.

39. The method of claim 34 wherein the first reservoir and the second reservoir are positioned below the compressor such that liquid refrigerant condensed flows toward the first reservoir and the second reservoir.

* * * * *